US007236603B2

(12) United States Patent
Mergell

(10) Patent No.: US 7,236,603 B2
(45) Date of Patent: Jun. 26, 2007

(54) DEVICE AND METHOD TO ADAPT A HEARING DEVICE

(75) Inventor: Patrick Mergell, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 478 days.

(21) Appl. No.: 10/675,303

(22) Filed: Sep. 30, 2003

(65) Prior Publication Data

US 2004/0131195 A1 Jul. 8, 2004

(30) Foreign Application Priority Data

Sep. 30, 2002 (DE) ..... 102 45 567

(51) Int. Cl.
*H04R 25/00* (2006.01)

(52) U.S. Cl. ..... 381/312; 381/110

(58) Field of Classification Search ..... 381/312, 381/60; 73/585; 600/25, 559; 623/10
See application file for complete search history.

(56) References Cited

U.S. PATENT DOCUMENTS 4,731,850 A 3/1988 Levitt et al.
5,852,668 A 12/1998 Ishige et al.
6,370,255 B1 4/2002 Schaub et al.

FOREIGN PATENT DOCUMENTS

| | | |
|---|---|---|
| DE | 690 12 582 T2 | 4/1994 |
| EP | 0 788 290 A1 | 8/1997 |
| EP | 0 820 212 A2 | 1/1998 |
| WO | WO 91/08654 | 6/1991 |
| WO | WO 01/76321 A1 * | 10/2001 |

* cited by examiner

*Primary Examiner*—Sinh Tran
*Assistant Examiner*—Walter F Briney, III
(74) *Attorney, Agent, or Firm*—Schiff Hardin LLP

(57) ABSTRACT

In the adaptation of hearing devices to specific auditory situations, mistakes can be reduced between detected auditory situations, and individual classifications should be enabled. For this, evaluation data are provided for various predetermined auditory situations, and the hearing device adapted to a hearing device user using individual weighting. The individual weighting thereby ensues via a continuous weighting function that runs via supporting points which respectively represent an individual weighting of the evaluation data of one of the predetermined auditory situations. With this, a continuous and individual adaptation of the hearing device to various auditory situations is possible.

12 Claims, 3 Drawing Sheets

DEVICE AND METHOD TO ADAPT A HEARING DEVICE

BACKGROUND OF THE INVENTION

The present invention concerns a method to adapt a hearing device by providing evaluation data for various predetermined auditory situations and adapting the hearing device to a hearing device user by use of individual weighting. Moreover, the present invention concerns a corresponding device to adapt a hearing device as well as an individually adaptable hearing device.

A hearing device is known from the German patent document no. DE 690 12 582 T1 that the user can individually adapt by way of a menu control. The user gains access to a new parameter set for a specific response function that is then input into a digital signal processor via taps on a control keypad. By way of a few touches, the user can find the response function fitting his or her acoustic surrounding and the necessary amplification. Furthermore, a programmable digital hearing device system is known from U.S. Pat. No. 4,731,850. An adaptation of the electro-acoustic properties of the hearing device to the patient and to the surrounding can ensue via programming,. Selected parameter values are loaded into a programmable storage (EEPROM) that supplies the corresponding coefficients to a programmable filter and to an amplitude limiter of the hearing aid in order to thus achieve an automatic adaptation for surrounding noises, speech levels, and the like.

In principle, a danger exists for a hearing aid device user in that the hearing device may mistakenly detect an auditory situation. In the case that such a mistake ensues, the hearing device adapts with its hearing device parameters to a auditory situation that does not currently exist. With this, the audio signals are inappropriately relayed to the hearing aid device user. If, for example, the auditory situation "speech in low background noise" is confused with the auditory situation "music", in this circumstance, unnecessary or, respectively, interfering frequency portions are transmitted, or specific frequency portions are inappropriately amplified.

In present hearing devices, an unclear connection exists in many cases between a specifically detected auditory situation and the hearing device parameters. In many cases, the connection between detected auditory situations and corresponding hearing device adjustments is also realized very simply in the current prior art. In noise situations, for example, the directional microphone and the noise reduction is activated. A classifier recognizes and classifies a current auditory situation and switches back and forth between a selection of hearing device programs with a plurality of parameters. However, the problem exists thereby that a current auditory situation by itself does not correspond to a standardized, typical auditory situation. Correspondingly, a known uncertainty exists as to which hearing device program the hearing device should switch to or, respectively, which hearing device parameters are to be adjusted to for the optimal use of the hearing device. Typical problem cases involve mixed situations when, for example, speech should be transmitted before the background of music and other ambient noise.

SUMMARY OF THE INVENTION

The object of the present invention is to provide a different way for the adaptation of a hearing device to a current auditory situation.

This object is inventively achieved via a method to adapt a hearing device by providing evaluation data for various predetermined auditory situations, and adapting the hearing device to a hearing device user by way of individual weighting, whereby the individual weighting ensues via a continuous weighting function that runs via supporting points which respectively represent an individual weighting of the evaluation data of one of the predetermined auditory situations.

Furthermore, the object cited above is inventively achieved by a device to adapt a hearing device, with a storage device to provide evaluation data for different predetermined auditory situations, and an adaptation device to adapt the hearing device to a hearing aid device user by way of individual weighting, whereby with the adaptation device the individual weighting can be implemented by a continuous weighting function that runs through supporting points that respectively represent an individual weighting of the evaluation data of one of the predetermined auditory situations of the storage device.

In an advantageous manner, with this the hearing device parameters can continuously be adapted to different auditory situations. The discontinuous change of a complete hearing device parameter set can by prevented, such that a current auditory situation does not have to be discretely associated with a predetermined class.

The evaluation data are advantageously determined offline in advance via a noise signal analysis. For this, a databank with a plurality of evaluation data for a plurality of auditory situations can be assembled as supporting points for a continuous function. The evaluation data can thereby comprise weighting vectors with regard to specific audio signals that are characteristic of the predetermined auditory situations. Such weighting vectors are advantageously determined via an eigenvector analysis of the specific audio signals.

In a "fitting analysis", the weighting function for the individual weighting can be determined from auditory situations characteristic for the hearing aid device user. With this, the hearing aid device can specifically be responsive to the habits of the hearing aid device user, and those auditory situations that ensue most frequently with him or her can be used as a basis for the adjustment of the hearing device.

The weighting function is advantageously determined from at least one adaptation parameter and at least one value of the evaluation data. To refine the individualization of a hearing device, a plurality of values of the evaluation data can also be consulted to achieve the weighting function.

DESCRIPTION OF THE DRAWINGS

The present invention is more closely explained using the attached drawings that illustrate preferred embodiments of the invention.

DETAILED DESCRIPTION OF THE PREFERRED EMBODIMENTS

The subsequently specified exemplary embodiments represent preferred embodiments of the present invention. The method to adapt a hearing device to a hearing aid device user or, respectively, his or her hearing loss inventively comprises two offline methods and a real-time method. First, in an offline sound signal analysis, a plurality of typical audio signals is analyzed for characteristic evaluation data. Subsequently, in an offline adaptation analysis, an individual adaptation function with the characteristic evaluation data is acquired for a hearing aid device user. Finally, in a real-time method, the hearing device is individually adjusted for a current auditory situation with the aid of the acquired adaptation function.

In detail, the offline sound signal analysis serves to determine generic auditory situations from which auditory situations such as "speech in low background noise" or "music" are assembled or, respectively, merged. The advantage of considering generic auditory situations is that they are unambiguously, separate. Mathematically, these generic auditory situations are specified by feature vectors that are orthogonal to one another and ensue from a Principle Component Analysis (PCA) of the feature vectors of prevalent auditory situations. However, prevalent auditory situations, such as some music, speech, etc., are not orthogonal to one another and thus do not separate from one another. The specification of prevalent auditory situations via generic auditory situations in the form of orthogonal feature vectors enormously reduces the further data processing effort. The results of a PCA are key input for further steps.

Figure 1:
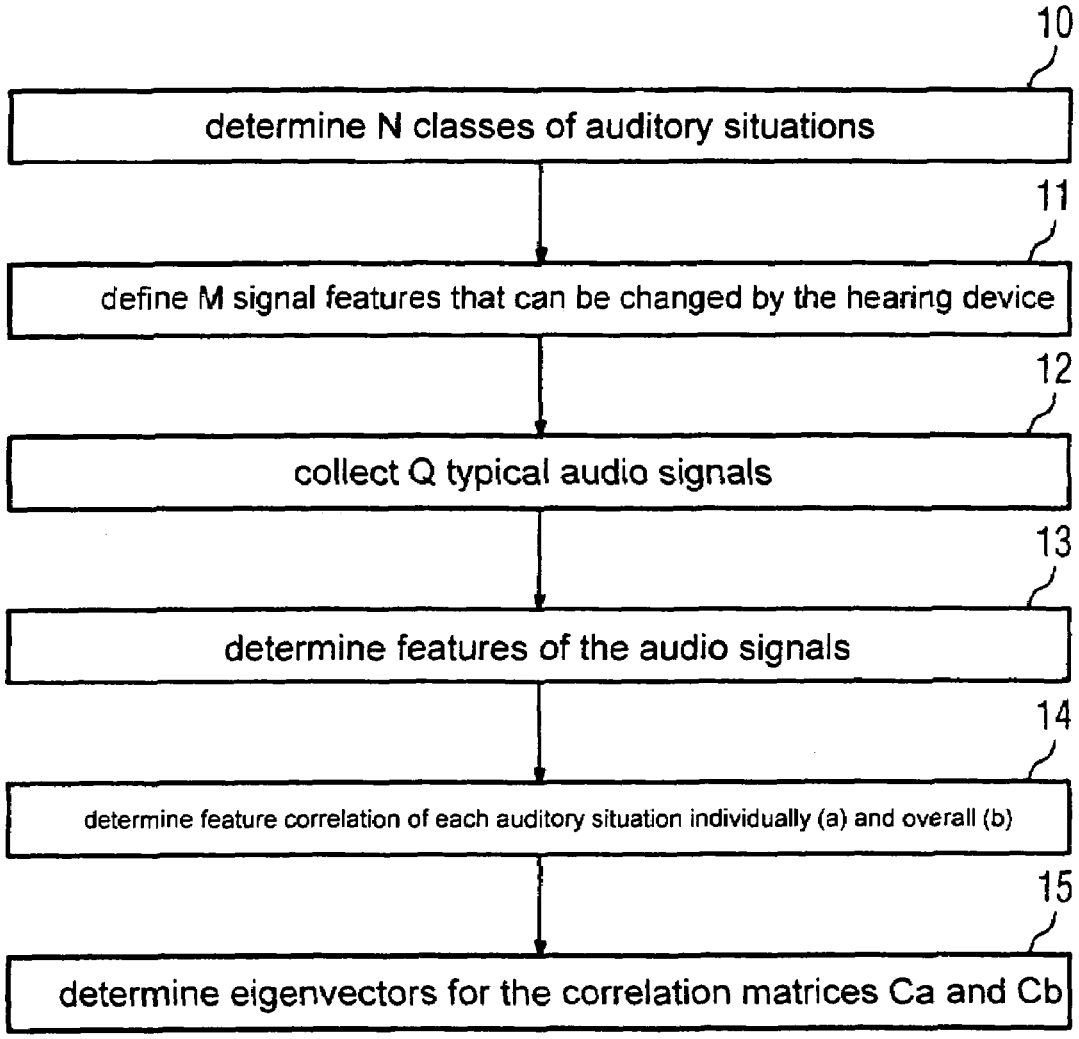
FIG. 1 is a flow chart for an offline noise signal analysis.

In the flow chart of FIG. 1, the key steps of an offline sound signal analysis are shown in principle. In a step 10, N classes of auditory situations are initially determined. Such classes would be, for example: $H_1$=speech in low background noise, $H_2$=loud speech in low background noise, $H_3$=speech in high background noise, $H_4$=music, etc.

In step 11, M signal features that can be changed by the digital signal processing of the hearing device are defined. Such signal features would, for example, be $F_{1 \ldots j}$=spectral envelopes (LPC coefficients), $F_{i \ldots j}$=modulation power density spectrum, etc.

In a subsequent step 12, Q typical audio signals are collected for each auditory situation $\{X_i\}_{Hj}$. These then correspond to a sound example databank for the different auditory situations.

According to step 13, the features of the audio signals determined in step 12 are thereupon determined. These result in $F_{ijk}=F_i(\{x_j\}_{Hk})$, i=1 . . . M, j=1 . . . Q, k=1 . . . N.

In step 14 the feature correlation is determined individually (a) and overall (b) for each auditory situation. The correlation matrices $C_a$ and $C_b$ result from this.

Finally, in step 15, the eigenvectors that correspond to the generic auditory situations or, respectively, the individual features of the correlation matrices $C_a$ and $C_b$ are determined via diagonalization or normalization. Furthermore, the normalized eigenvalue (statistical weightings) are determined for the subsequent adaptation process.

In this connection, for example, the speech feature vector $V_{max}$ and generic feature vectors $V_{gi}$ are determined. The speech feature vector $V_{max}$ corresponds to the $C_a$ eigenvector for "speech in low background noise" with the highest eigenvalue. However, the generic feature vectors $V_{gi}$ represent the n $C_b$ eigenvectors with the highest eigenvalues, with which, for example, 95% of all audio signals can be reconstructed.

The feature vector of an arbitrary audio signal can be considered as a superposition of generic feature vectors: $F=a_1*V_{g1}+a_2*Vg_1+ \ldots a_1, \ldots ,a_n$ thereby mean the weighting vectors of a specific audio signal.

The possibility that an arbitrary audio signal corresponds to the typical auditory situation "speech in low background noise" is: $p=F*V_{max}$ With the offline sound signal analysis, the primary features or, respectively, primary eigenvectors of typical auditory situations, are thereby determined via correlation of the individual features such as, for example, modulation depth, modulation frequency, energy in a frequency band, etc. The weightings, of the primary features represent, as was already mentioned, approximately 95% of the sum of all weightings whereby the typical features can be discarded. Each typical auditory situation can thus be relatively unambiguously characterized by a few primary features.

The offline adaptation analysis serves on the one hand to determine an individual base adaptation, for example the hearing device adaptation that a specific person hard of hearing gauges as optimal for speech in low background noise. On the other hand, the offline adaptation analysis serves to determine the necessary parameter changes dependent on the mixing ratio or relationship of the generic auditory situations. This results in a functional correlation between the mixing parameters of a given auditory situation and the individual and optimal hearing device parameters for this situation.

The advantage of this is that the hearing device parameters fitting an auditory situation are individually determined for the hearing aid device user, and, given fluid transitions of auditory situations, can be fluidly changed since the functional correlation was determined. This method should be implemented in the hearing device adaptation software because the function that forms the mixing parameters must be determined with the adaptation software and programmed into the hearing device.

Figure 2:
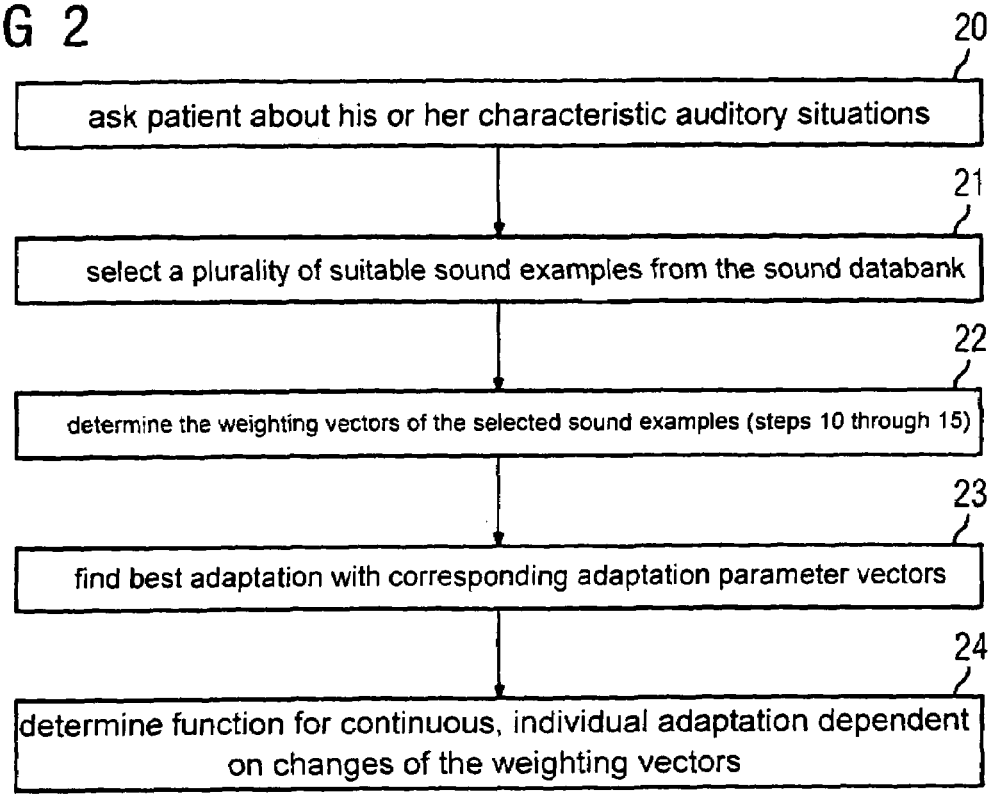
FIG. 2 is a flow chart for an offline adaptation analysis.

The individual hearing loss of a patient is considered as follows in the offline fitting analysis or offline adaptation analysis (FIG. 2). In step 20, the patient is first asked about characteristic auditory situations in his or her social environment. He or she then names those auditory situations that have the greatest importance to him or her or, respectively, ensue most frequently, such as "speech in low background noise", "telephone", and so forth.

For this, a plurality of appropriate audio examples are selected from the audio databanks generated according to the steps 10 through 12. The data set $x_0$ corresponds, for example, to the audio example "speech in low background noise". n different audio examples $X_0 \ldots x_n$ are available.

In step 22, the weighting vectors $a_0 \ldots a_n$ of the selected sound examples are determined. They are taken from the databank generated in the offline sound signal analysis.

The best individual adaptation with corresponding adaptation parameter vectors is determined according to step 23. For this, for example, the preparation of the interactive, adaptive fitting is selected for the sound example. The corresponding adaptation parameter vectors or fitting parameter vectors are $b_0 \ldots b_n$. This step ensures a subjective evaluation of typical, objective auditory situations.

In step 24, a function is finally determined with which the individual adaptations can be continuously implemented based on the changes of the weighting vectors. For example, it is possible with the aid of the values $a_0$ and $b_0$ as reference to predict individual adaptation changes as a function of the weighting changes. The complexity of this prediction or, respectively, its precision is dependent on the dimension of the vectors a and b, i.e., the number of the analyzed features and the number of the adaptation parameters. A function is yielded as a result $b=b_0+\phi(|a_0-a|)$ or, respectively, $b=b_0+c_1$ $|a_0-a|+c_2\ |a_0-a|^2+\ldots$ The Taylor coefficients $c_1$, $c_2$ . . . can be determined via regression. The determined function, based on one or more coefficients, thus quantizes the relationship between objective auditory situation and subjective perception.

The real-time classification or, respectively, real-time adjustment of the hearing device enables that, given detection of a specific mixing ration of generic auditory situations, the corresponding hearing device parameter set is active and the transition is fluid.

Figure 3:
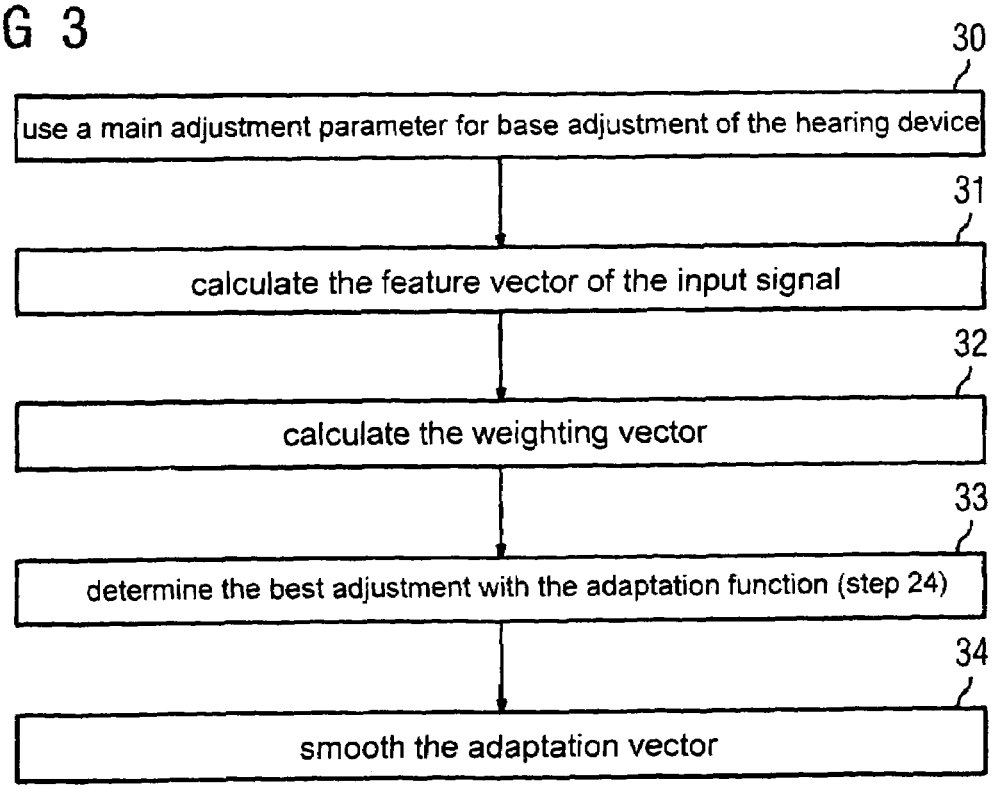
FIG. 3 is a flow chart for a real-time classification.

The individual function determined in the steps 20 through 24 is used during the operation of the hearing device for real-time classification according to the method procedure of FIG. 3. In this real-time adjustment of the hearing device, according to step 30 a main adjustment parameter is used for basic adjustment of the hearing device. The main adjustment parameter $b_0$ individually classifies the auditory situation that is most important for the patient.

In step 31, the feature vector of the input signal is determined as a function of time F=F(x). The basis of this determination is the input signal in a time window, whereby the feature vector yields uniformly for this window.

The weighting vector is determined in step 32 according to the function specified above $F=a_1*V_{g1}+a_2*V_{g1}+\ldots$ as a function of time.

With the aid of the individual adaptation function $b=b_0+\phi(|a_0-a|)$ determined in step 24, in step 33 the best individual adjustment or, respectively, adaptation of the hearing device to the current auditory situation is effected. It is thereby possible to continuously monitor mixing situations, and to adjust the hearing device to individual requirements of the patient or, respectively, hearing aid device user.

For this, in step 34 the adjustment vector or, respectively, adaptation vector is smoothed.

The advantage of this real-time classification is the relatively small computer effort of M multiplications, where M corresponds to the number of features. Moreover, relatively little storage space is required, namely M bytes. However, approximately N additional control signals are necessary, where N corresponds to the number of the controlled hearing device parameters.

An individualization with regard to the adjustment of a hearing device, as well as an improved adaptation to mixings of typical auditory situations, is thus inventively possible.

Mistakes between detected auditory situations are severely reduced via the inventive device or, respectively, the inventive method. An unambiguous mapping of auditory situations to hearing device parameters ensues, as well as an individual classification.

Figure 4:
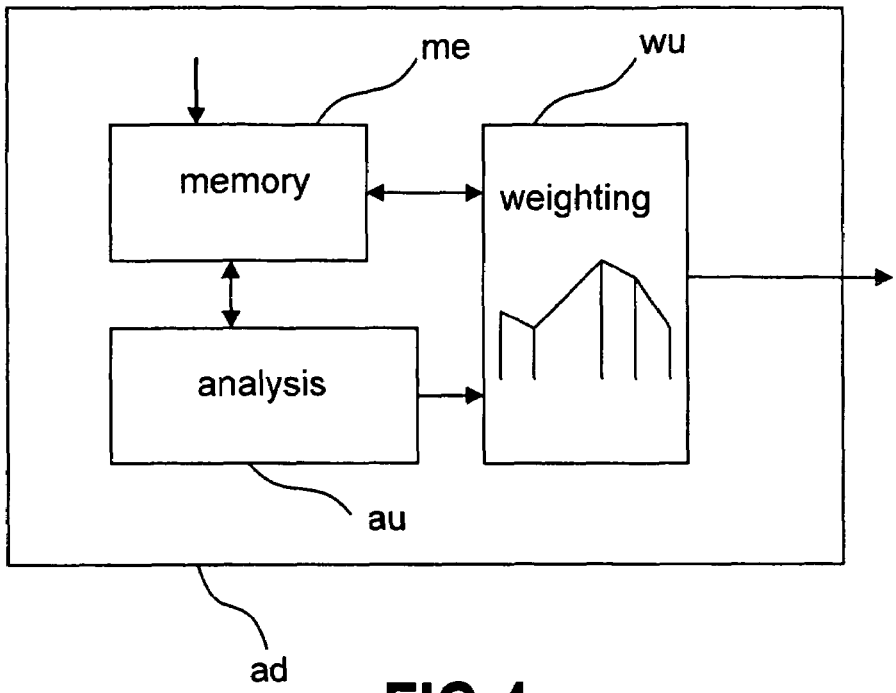
FIG. 4 is a block diagram illustrating a device to adapt a hearing device.
Figure 5:
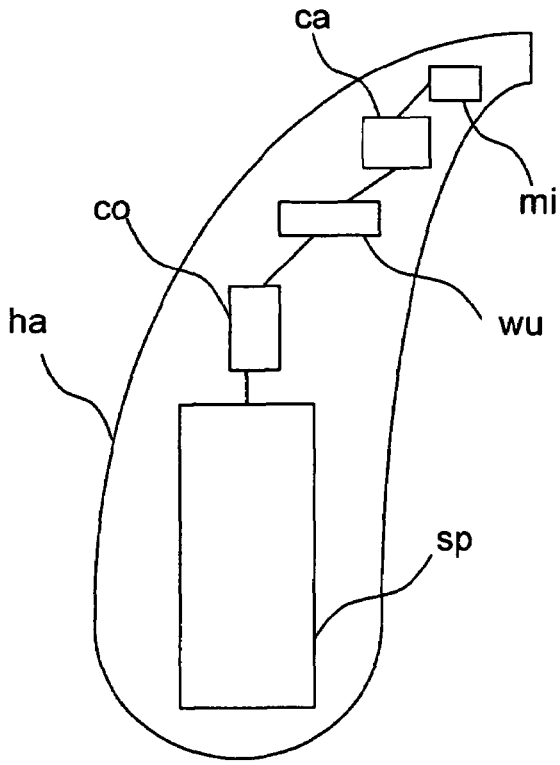
FIG. 5 is a block diagram of a hearing device.

FIG. 4 illustrates the adapting device ad that comprises a memory/databank me, an analysis unit au and a store wu for the weighting(s). FIG. 5 relates to a hearing device ha comprising a recording device mi, computer device ca, weighting device wu, control device co and a signal processor sp.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A method to adapt a hearing device, comprising:

providing evaluation data for various predetermined auditory situations;

adapting the hearing device to a hearing aid device user with individual weighting via a continuous weighting function that runs via supporting points that respectively represent an individual weighting of the evaluation data of one of the predetermined auditory situations, wherein the evaluation data comprise weighting vectors with regard to specific audio signals that are characteristic of the predetermined auditory situations; and determining the weighting vectors by performing an eigenvector analysis of the specific audio signals.

2. The method according to claim 1, further comprising:

performing a sound signal analysis; and determining the evaluation data based on results of the sound signal analysis.

3. The method according to claim 1, further comprising determining the weighting function for the individual weighting from auditory situations characteristic for the hearing device user.

4. The method according to claim 1, further comprising determining the weighting function from at least one adaptation parameter and at least one value of the evaluation data.

5. A method for operating a hearing device, comprising:

recording an audio signal of a current auditory situation;

calculating signal evaluation data from the audio signal;

weighting the signal evaluation data utilizing a continuous weighting function that is acquired by utilizing weighting vectors with regard to specific audio signals that are characteristic of a predetermined auditory situation;

adapting the hearing device according to the weighted signal evaluation data to the current auditory situation; and determining the weighting vectors by performing an eigenvector analysis of the specific audio signals.

6. The method for operating a hearing device according to claim 5, wherein the adapting of the hearing device is performed under real-time conditions.

7. A device to adapt a hearing device, comprising:

a storage device configured to provide evaluation data for various predetermined auditory situations;

an adaptation device configured to adapt the hearing device to a hearing aid device user using individual weighting; and a continuous weighting function configured to implement, with the adaptation device, the individual weighting, the continuous weighing function configured to run via supporting points which respectively represent an individual weighting of the evaluation data of one of the predetermined auditory situations of the storage device, wherein the evaluation data comprises weighting vectors with reguard to specific audio signals that are characteristic of the predetermined auditory situations; and an analysis device with which the weighting vectors can be determined via eigenvector analysis of the specific audio signals.

8. The device according to claim 7, further comprising:

a sound signal analysis device with which the evaluation data can be determined for the predetermined situations, and from which the evaluation data can be transferred to the storage device.

9. The device according to claim 7, further comprising an offline adjustment device configured to determine the weighting function for the individual weighting from auditory situations characteristic for the hearing device user.

10. The device according to claim 9, wherein the weighting function can be determined from at least one adaptation parameter and a plurality of the evaluation data via the offline adjustment device.

11. A hearing device comprising:

a recording device configured to record an audio signal of a current auditory situation;

a computer device configured to calculate signal evaluation data from the audio signal;

a weighting device configured to weight the signal evaluation data with the aid of a continuous weighting function;

a control device or regulation device configured to adapt the hearing device according to the weighted signal evaluation data to the current auditory situation, wherein the evaluation data comprise weighting vectors with reguard to specific audio signals that are characteristic of a predetermined auditory situation, and;

an analysis device with which the weighting vectors can be determined via eigenvector analysis of the specific audio signals.

12. The hearing device according to claim 11, wherein the control device or regulation device is configured to adapt under real-time conditions.

* * * * *